US006213467B1

(12) United States Patent
Andrews

(10) Patent No.: US 6,213,467 B1
(45) Date of Patent: Apr. 10, 2001

(54) ELECTRONIC GAME BOARD

(76) Inventor: Patricia L. Andrews, 1700 S. Grand Ave., Suite 102, Santa Ana, CA (US) 92705

( * ) Notice: Subject to any disclaimer, the term of this patent is extended or adjusted under 35 U.S.C. 154(b) by 0 days.

(21) Appl. No.: 09/421,655

(22) Filed: Oct. 20, 1999

(51) Int. Cl.[7] ..... A63F 3/00
(52) U.S. Cl. ..... 273/236; 463/11
(58) Field of Search ..... 463/11, 26, 27, 463/25, 29, 30, 31, 35, 36, 37, 38, 46, 47; 273/236, 287, 292, 293, 153

(56) References Cited

U.S. PATENT DOCUMENTS

| | | | | |
|---|---|---|---|---|
| 3,893,671 | | 7/1975 | Gardner . | |
| 4,146,235 | * | 3/1979 | Brautovich | 273/273 |
| 4,323,243 | | 4/1982 | Hanson et al. . | |
| 4,324,405 | | 4/1982 | Kruger, Jr. et al. . | |
| 4,545,582 | | 10/1985 | Andrews . | |
| 4,779,873 | * | 10/1988 | Joergensen | 273/237 |
| 5,346,225 | * | 9/1994 | Walling | 273/294 |
| 5,586,764 | * | 12/1996 | Katz | 273/293 |
| 5,938,528 | * | 8/1999 | Glapion | 463/11 |

* cited by examiner

*Primary Examiner*—Valencia Martin-Wallace
*Assistant Examiner*—Kim T. Nguyen
(74) *Attorney, Agent, or Firm*—Lynn & Lynn

(57) ABSTRACT

An electronic game board for a domino game has a flat playing surface for two to eight playing positions. A switch at each playing position is arranged to activate a corresponding light source. A dome is mounted to the board to provide a location for displaying a master domino tile and to provide a housing for a power source that is connected to the LED's.

7 Claims, 4 Drawing Sheets

ELECTRONIC GAME BOARD

BACKGROUND OF THE INVENTION

This invention relates to the field of games for amusement and entertainment. More particularly, this invention relates to an electronic game board which is capable of being used in conjunction with a known or conventional domino game thereby providing expanded and more pleasurable enjoyment of the game.

Board games in one form or another have been available in the market place for years. While certain other boards are available for playing the game, this board is meant to enhance the pleasure of the game in a visual and/or audible sense.

In addition, electrically operated games with electric means for indicating a selected board position are also well known. Representative of such games are U.S. Pat. Nos. 3,893,671; 4,323,243; 4,324,405; and 4,545,582.

SUMMARY OF THE INVENTION

Summarized briefly, the invention provides a novel electronic game board capable of being used in conjunction with a conventional game of dominoes. The novel board of the present invention preferably has a flat surface consisting of eight sides, each side having a cutout capable of receiving a domino tile. An LED and a corresponding switch are positioned at each cutout. The present invention contains a raised dome placed in the center of the board thus providing a place for a master tile to be displayed. The raised dome can house an electronic power source.

The advantages of this electronic board will be apparent to and understood by those skilled in the art of playing the game from the following detailed descriptions and drawings.

These and other objects of the present invention will become more apparent with reference to the following description in conjunction with the accompanying drawings.

DESCRIPTION OF THE PREFERRED EMBODIMENT

Figure 1:
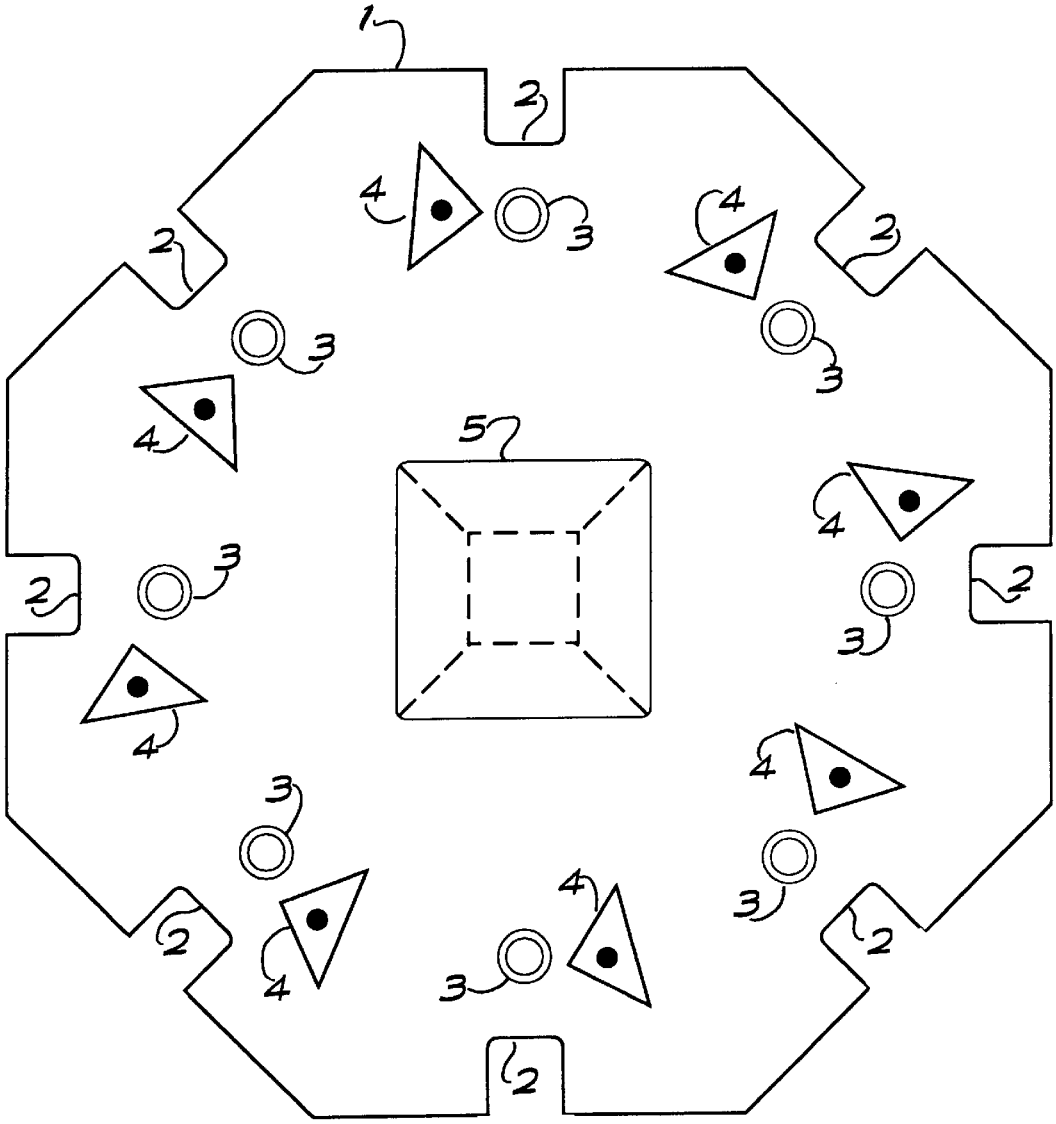
FIG. 1 is a top plan view of one embodiment of the present invention. A cutout is duplicated at each of the eight positions. An LED device is positioned at each cutout. A switch is positioned at each cutout. An elevated platform is positioned in the center of the board to display the master domino tile.
Figure 3:
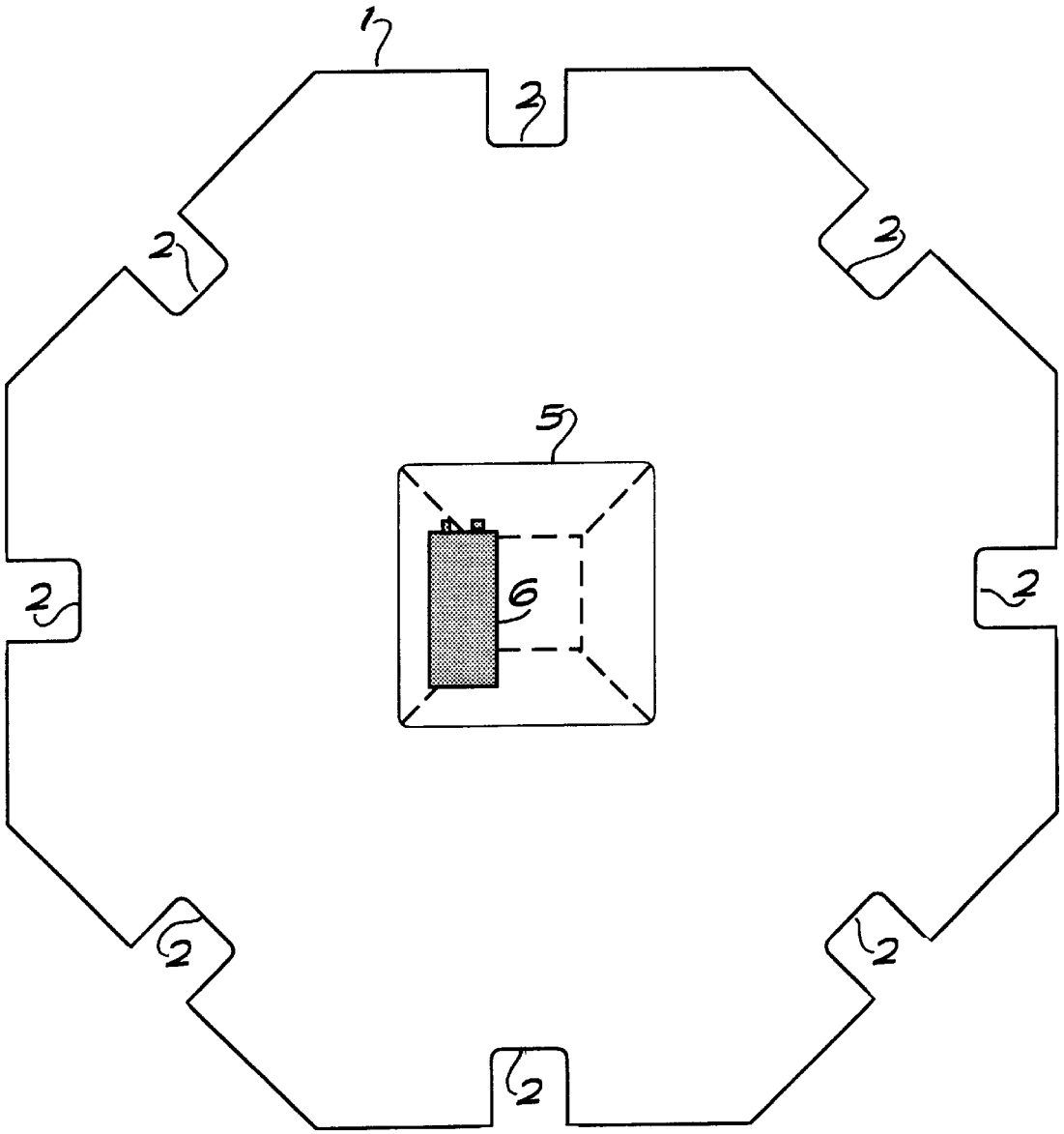
FIG. 3 is a view of the underside of the board revealing a cavity which is capable of housing an electronic source, such as a battery, providing power to the LED devices.

Referring to the drawings wherein like characters are used for like parts throughout, there is shown in FIG. 1 an electrical board game device 1. In accordance with the present invention, the board 1 preferably has a flat bottom octagonal surface as shown in FIG. 3. Features of the game board explained subsequently are formed on the upper side thereof. The thickness of the game board 1 preferably is about the same as that of a typical domino tile (about 0.25" to 0.375"). A plurality of generally rectangular cutouts 2 are formed around the perimeter of the game board 1. The cutouts 2 are formed so that an end of a domino tile may be inserted in them. In the illustrated embodiment of the invention, a cutout 2 is formed at each of eight positions that are preferably centered on the sides of the octagon.

A switch 4 is positioned near each cutout 2. An LED 3 or other suitable lighting device is positioned near each cutout.

Positioned in the center of the board is an elevated platform 5 having four sides with a flattened top so that the platform is a truncated rectangular pyramid.

Figure 2:
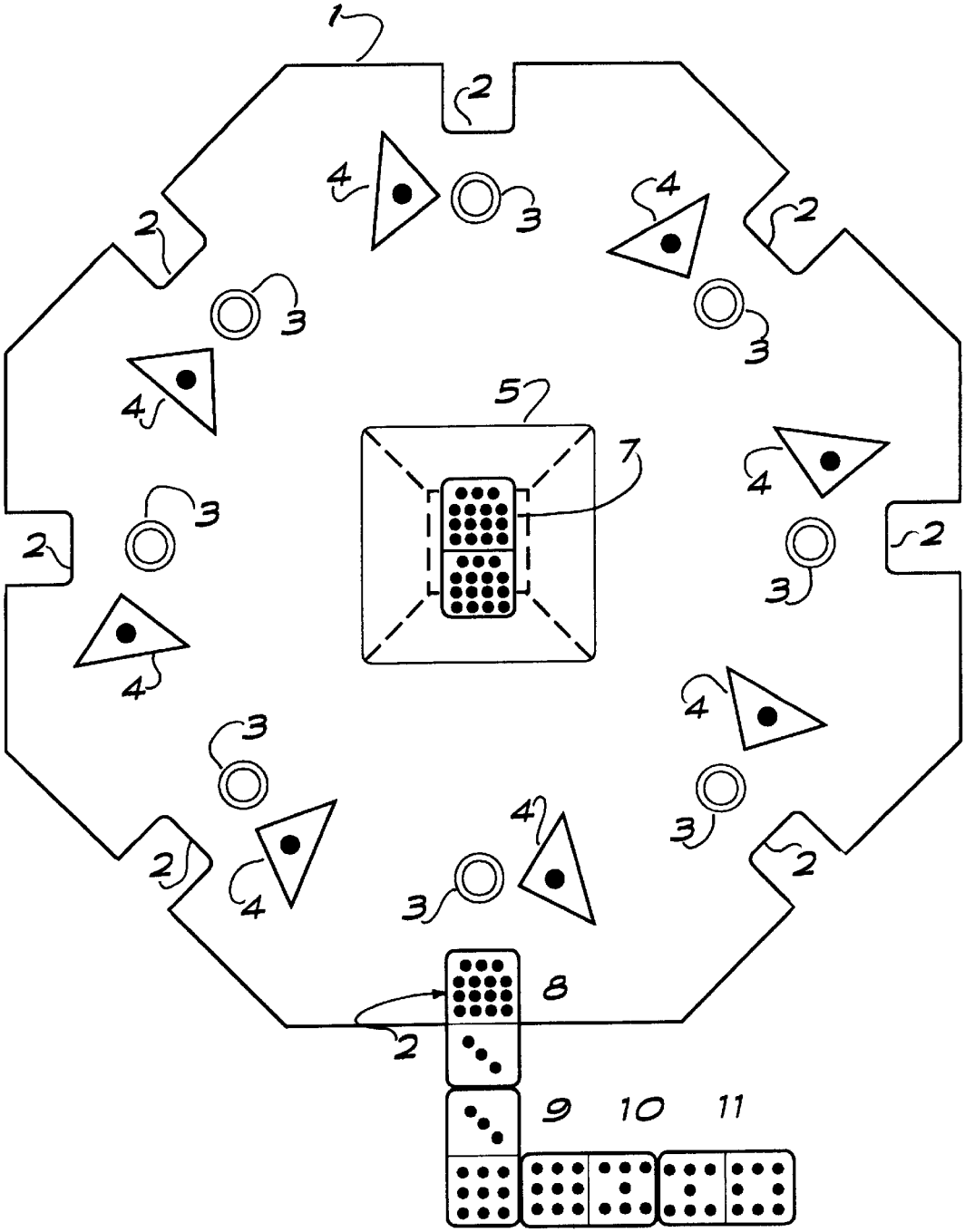
FIG. 2 is a view of the board showing a game in progress displaying the relative positions of the domino tiles of one position as they are placed in accordance with the rules of the game.

FIG. 2 shows a game in progress for demonstration purposes only, displaying a double-fifteen as a master tile 7 on the elevated and flattened dome 5 and also shows a sequence of four tiles, such as 15-3 tile 8, 3-9 tile 9, 9-7 tile 10 and 7-8 tile 11 having been played at one position. Similar placement of tiles played at other positions is not shown.

FIG. 3 shows the underside of the board displaying a compartment 5 meant to house a power source 6 required to activate the LED's 4. The power source 6 preferably is a battery located in a cavity in the underside of the dome 5. The power source 6 is connected to the LED devices following normally accepted wiring techniques. Each LED 3 is connected to the power source 6 so that toggling the switches 4 turns the corresponding LED's on and off.

Figure 4:
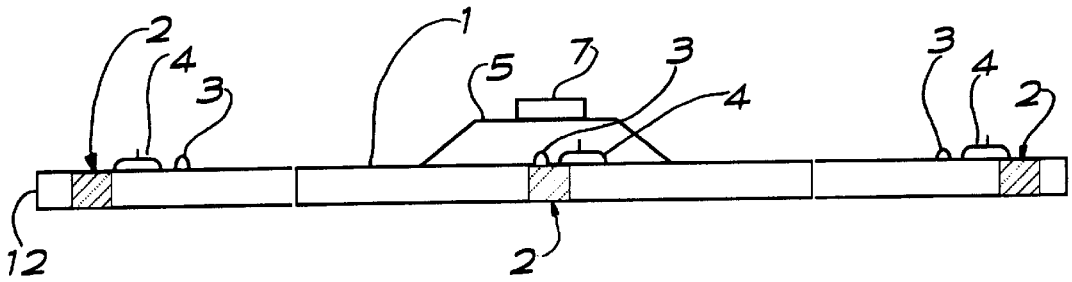
FIG. 4 is a cross-section drawing indicating the relative height of the board showing three cutouts, three LED devices, three switches, the elevated and flattened dome and a placed master domino tile.

FIG. 4 is a cross section drawing showing the relative height 12 of the board displaying three cutouts 2 and the elevated and flattened dome 5 supporting a master tile 7 and the switches 4 and LED devices 3.

While the invention has been disclosed herein in connection with certain embodiments, it will be understood that this is intended by way of illustration only, and that modifications may be made in the configuration of the board game as well as in the steps of the method by which it is formed without departing from the spirit of the invention and it is intended the invention and these modifications be covered by the appended claims.

METHOD OF PLAY

The referred-to game is commonly played with double-six domino tiles, double-nine domino tiles, double-twelve domino tiles or double-fifteen domino tiles, and each game can be played by two to eight players. The object of the game is to win by going out with the lowest score.

Play commences with all the tiles spread face down on a playing surface such as a table. Domino tiles have indices on one side only, the reverse side of the tile being blank. As such, since no indices are inscribed on the reverse side of the domino tile this manner of gathering tiles assures random selection. Each participant selects a prescribed number of tiles, this amount having been agreed upon prior to the start of the game, and places them at his assigned position in such manner to assure the indices are visible to that particular player only; thus this store of tiles shall be visible to no other player, until played. Ordinarily after each player selects his prescribed number of domino tiles, there will be a number of unchosen tiles remaining face down.

Before the first round begins, a master domino tile, such as a double fifteen 7, is placed in the center of the board 1 on the elevated position 5.

Each player's line of domino tiles shall be started at his own assigned position 2 with a tile whose left side matches the number of the master double tile 7. Each player shall start his own line of tiles by matching the master tile from his existing store of domino tiles. If a player can match the master tile 7, he places a domino tile at his own preassigned position 2 and play progresses to the next player in a clockwise fashion. If a player cannot match the master tile, he draws one tile from the supply of available tiles. If the newly selected tile matches the master tile, it is placed in the player's cutout; and the next player's turn begins. If the newly selected tile does not match the master tile, then the player switches on his LED to indicate that he cannot play any of his dominos at his cutout. Play then progresses to the next player. When a player's LED is on, then his cutout is vulnerable to the receipt of a matching tile from the other players as they take their turn. The player switches his light off after another player plays a domino that would then allow the player to play one of his own dominoes in the line of dominoes at his own position.

At his next turn, a player may play by matching a left tile to the right tile having been previously played at his own position. For example: 15-3, 3-9, 9-7, 7-8, and so on. During his turn a player may also play by matching a tile at the position of any other player whose LED optical signal is on. At each turn if none of a player's tiles match the end tile at any eligible player position, then the player has to draw a new tile, which may be then played at any eligible player position where it matches. The eligible player positions include the player's own cutout and all others where the corresponding LED is on. If the new tile will not play, then the player switches on his LED to indicate that he is vulnerable.

During a round of play one person can go out by playing all his tiles. At such time play stops, and each of the other players must total the indices on each of the unplayed tiles remaining in his possession and report the total number to the scorekeeper. As the first round, and subsequent rounds, of play are completed and the scores are tallied, then and only then does the next round commence by displaying a master tile 7 with a descending value such as a double fourteen and such subsequent round shall be indicated by placing a domino tile on the elevated center 5.

The last master tile 7 played can be either a double blank or any double tile agreed to by the players prior to start of the game.

The player with the lowest score after all rounds have been played is the winner.

This invention is meant to provide a brightly illuminated indicator 3 whereby each player may readily recognize the opportunity to play off his tiles on any position 2 other than his own thereby reducing his score and thus increase his chance of winning the game.

What is claimed is:

1. An electronic gaming device, comprising:

a board having a generally flat lower surface that forms a base and a generally flat upper surface;

indicia marking a plurality of player positions formed on the board, the indicia being formed as a plurality of cutouts in outer edges of the base with each of the cutouts being arranged to accommodate a single domino tile being placed thereinto;

a lighting device mounted to the board adjacent each player position, a corresponding switch connected to each lighting device such that toggling the switches turns the corresponding lighting device on and off;

a power source mounted to the board and arranged to provide electrical power to the lighting devices as the switches are turned on; and a raised dome mounted to the board.

2. The electronic gaming device of claim 1 wherein the base has as many as eight cutouts formed on its outer edges.

3. The electronic gaming device of claim 1 wherein the lighting devices comprise an LED positioned at each cutout.

4. The electronic gaming device of claim 1 wherein a manually operated switch is positioned at each of the cutouts and is connected to the corresponding LED.

5. The electronic gaming device of claim 4 wherein each switch manually operates the corresponding LED.

6. The electronic gaming device of claim 1 wherein the dome is arranged to display a master domino tile.

7. The electronic gaming device of claim 6 wherein the underside of the elevated and flattened dome is formed to contain electronic power equipment necessary to operate the LED's.

* * * * *